US005551149A

United States Patent [19]

Takeuchi

[11] Patent Number: 5,551,149

[45] Date of Patent: Sep. 3, 1996

[54] METHOD OF MAKING BUSBARS

[75] Inventor: Kunihiko Takeuchi, Kosai, Japan

[73] Assignee: Yazaki Corporation, Tokyo, Japan

[21] Appl. No.: 241,403

[22] Filed: May 11, 1994

[30] Foreign Application Priority Data

May 13, 1993 [JP] Japan ..... 5-111686

[51] Int. Cl.[6] ..... H01R 43/16

[52] U.S. Cl. ..... 29/874; 72/298; 140/92.1

[58] Field of Search ..... 29/825, 874, 846, 29/850; 72/298, 306, 295; 140/92.1

[56] References Cited

U.S. PATENT DOCUMENTS

| | | | |
|---|---|---|---|
| 357,186 | 2/1887 | Doshe-Chatain et al. | 72/298 |
| 391,058 | 10/1888 | McDougall et al. | 72/306 |
| 1,114,384 | 10/1914 | Prime | 140/92.1 |
| 3,185,184 | 5/1965 | Loy et al. | 140/93 R |
| 3,580,023 | 5/1971 | Merrill | 72/306 |
| 4,387,509 | 6/1983 | Dechelette | 29/850 |

FOREIGN PATENT DOCUMENTS

| | | | |
|---|---|---|---|
| 59-193725 | 11/1984 | Japan | 72/379.2 |
| 1-103167 | 7/1989 | Japan . | |
| 1-116514 | 8/1989 | Japan . | |

*Primary Examiner*—P. W. Echols

*Attorney, Agent, or Firm*—Armstrong, Westerman, Hattori, McLeland & Naughton

[57] ABSTRACT

The guide rib 20 is erected on the inner side of the bent busbar insertion groove 18. A strip of conductor piece D' cut to a specific length and held at its ends by the chucks 16 is positioned directly above the busbar insertion groove 18, after which the chucks 16 are lowered to bring the conductor piece D' close to the guide rib 20. The chucks 16 are then moved in arc to bend the conductor piece D' in the same shape as the guide rib 20. The formed conductor is then inserted into the busbar insertion groove 18.

8 Claims, 8 Drawing Sheets

METHOD OF MAKING BUSBARS

BACKGROUND OF THE INVENTION

1. Field of the Invention

The present invention relates to a busbar fabrication method, which allows a bent portion of a vertical busbar to be machined by a simple facility without using a die, the vertical busbar being adapted to be inserted into a busbar insertion groove formed in the surface of an insulating case and having a bent portion in such a manner that the width direction of the busbar is oriented vertically.

2. Prior Art

As shown in FIG. 10, Japanese Utility Model Preliminary Publications No. 1-103167 and No. 1-116514 disclose vertical busbars 3 which are upright widthwise and inserted into narrow busbar insertion grooves 2 formed in the surface of the insulation case 1.

The female terminal 5 connected to the vertical busbar 3 consists of a terminal connecting portion 6 and a wire connecting portion 8 that connects to a wire 7. The terminal connecting portion 6 has a cylindrical portion 6*a* formed with a slit 6*b* and two resilient clamping pieces 6*c* that bend U-shaped inwardly from the end of the cylindrical portion and are disposed close to each other. The busbar 3 is pressed into a slit between the two resilient clamping pieces 6*c*, thus providing electrical connection.

SUMMARY OF THE INVENTION

Although the aforementioned type of prior art vertical busbar 3 is advantageous in that busbars may be densely routed on the insulating case 1, manufacture cost is high because the bent portion 3*a* of the busbar 3 is formed by using expensive dies.

The present invention aims to solve this problem and to provide a busbar fabrication method in which the bent portion 3*a* may be formed without using a die.

To achieve the above object, the busbar fabrication method of this invention comprises the steps of:

cutting a belt-shaped thin electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above an insulating case having at least one bent guide groove therein and a guide rib rising from one side wall of said guide groove along said guide groove;

lowering said pair of chucks to bring said piece of conductor into contact with said guide rib;

causing at least one of said pair of chucks to move in a horizontal arcuate path about said guide rib to cause said piece of conductor to abut around said guide rib, thereby forming said piece of conductor into a busbar configured to said guide groove; and lowering said pair of chucks to insert said busbar into said guide groove.

Another embodiment of a method of making busbars according to the present invention comprises the steps of:

cutting a belt-shaped thin, plastically deformable electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above a jig plate having at least one pin rising from a surface thereof;

lowering the pair of chucks to position said piece of conductor into contact with said pin; and causing at least one of said pair of chucks to move in a horizontal arcuate path about said pin to cause said piece of conductor to bend.

Another embodiment of a method of making busbars according to the present invention comprises the steps of:

cutting a belt-shaped thin, plastically deformable electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above a jig plate having a plurality of holders, each of which includes a long pin and a short pin positioned relative to the long pin so that said piece of conductor is inserted therebetween, lowering said pair of chucks to position said piece of conductor into contact with a long pin of a first holder of said plurality of holders;

causing a first chuck of said pair of chucks to move in a horizontal arcuate path about said long pin to cause said piece of conductor to bend;

lowering said pair of chucks to insert said piece of conductor between the long pin and the short pin of said first holder while also inserting said piece of conductor between a long pin and a short pin of a second holder; and causing a second chuck of said pair of chucks to move in a horizontal arcuate path about the short pin of said second holder to cause said piece of conductor to bend.

A busbar fabrication method, in which the forming of busbar is carried out first and followed by its insertion into the busbar insertion groove, uses a jig plate having a plurality of pins erected thereon or one having clamping members each consisting of a long pin and a short pin erected thereon.

In the former method using the jig plate, the chucks are moved in an arc while holding the ends of the conductor piece to bend the conductor piece about the pins as fulcrums.

In the method using the jig plate having the holder each consisting of a long pin and a short pin erected thereon, the chuck lowering process is divided in two steps. That is, the first lowering step involves moving down the chucks to a height where the conductor piece does not interfere with the short pins and then moves the chucks in an arc about the long pins as fulcrums to bend the conductor piece. This is followed by further lowering the chucks until the conductor piece contacts the short pins, and bending the conductor piece about the short pins to form a busbar of complex shape.

BRIEF DESCRIPTION OF THE DRAWINGS

Features and other objects of the invention will become more apparent from the description of the embodiments with reference to the accompanying drawings in which.

DETAILED DESCRIPTION OF PREFERRED EMBODIMENTS

First embodiment

Embodiments of the invention will be described with reference to the accompanying drawings. As shown in the perspective view of FIG. 9, the busbar fabrication apparatus comprises a reel A, a busbar making section B, and a mounting stand C on which a jig plate 11 (see FIG. 9) or an insulating case 10 (FIG. 2) is mounted in position.

The reel A rotatably supports a rolled thin strip of conductor D.

Figure 8:
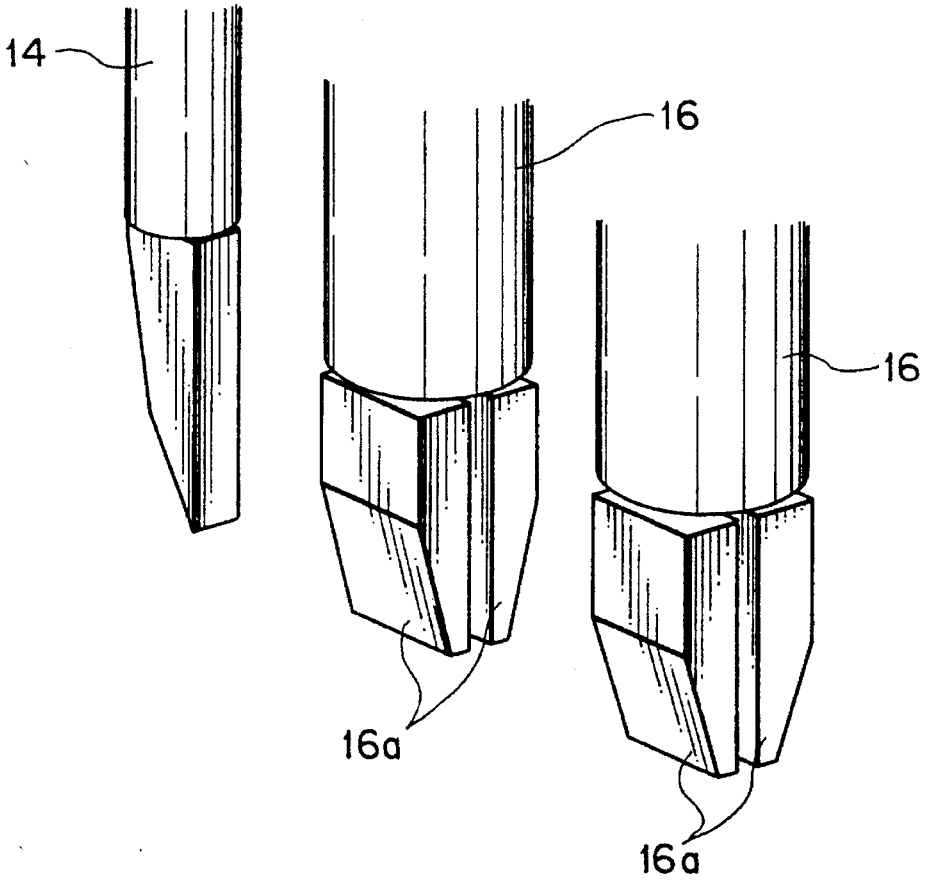
FIG. 8 is a perspective view of the front end portions of the cutter and the chuck.

The busbar making section B forms between the stand 12 and the die 13 a feeding path for the conductor D, which is unrolled and fed from the reel A. The busbar making section B includes a cutter 14 (see FIG. 8), which can be advanced and retracted from the stand 12 toward the die 13; a saddle 15 that can be moved up or down along the stand 12; clamping mechanisms 16*a* that clamp the conductor D with claws; two chucks 16 (FIG. 8) that can move in a straight line along the horizontal plane of the saddle 15 and also in an arc; and a push pin 17 (FIG. 1(D)).

Figure 1B:
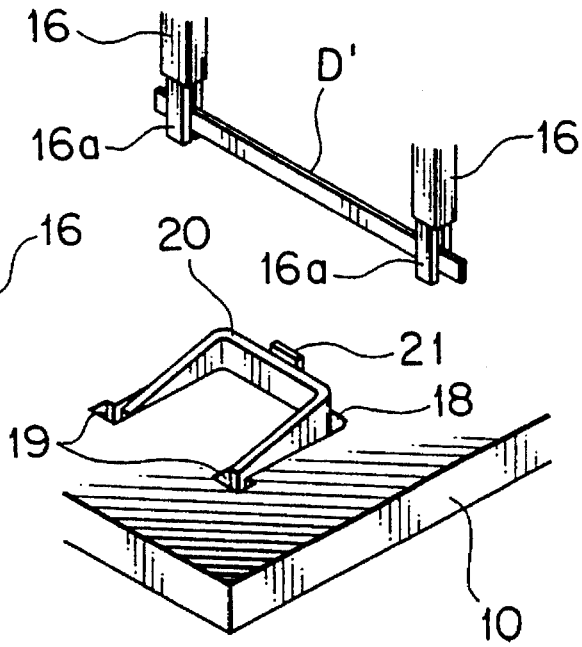
Figure 2:
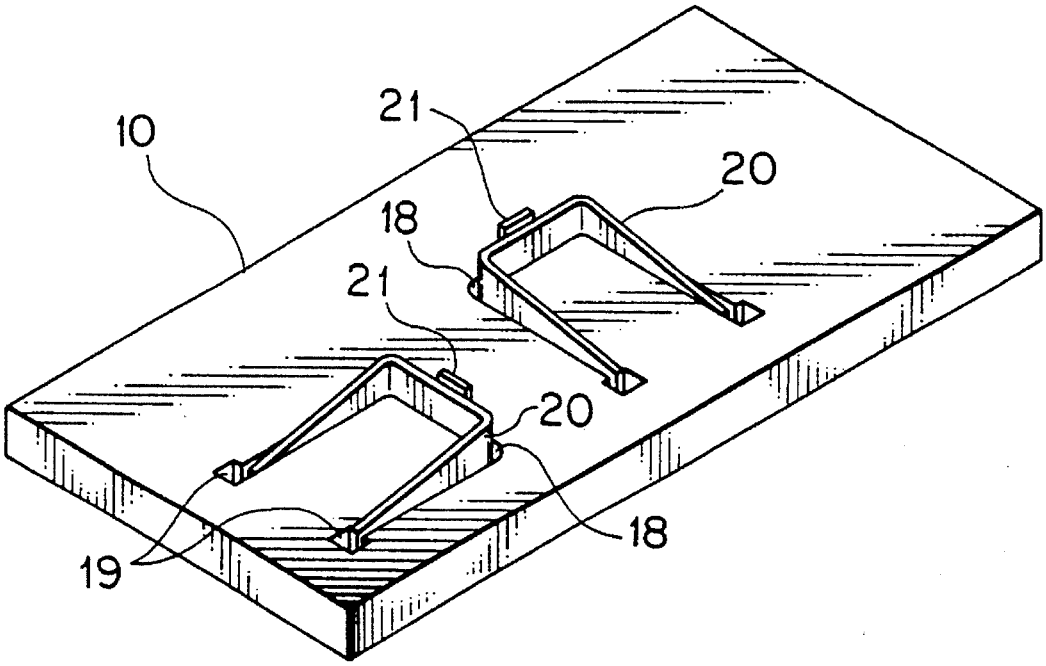
FIG. 2 is a perspective view of the insulating case.

The first embodiment of the busbar fabrication method using this fabrication apparatus is described as follows: The insulating case 10, as shown in FIG. 1(B) and 2, is formed with two U-shaped busbar insertion grooves 18 in its surface, each of which has female terminal insertion square holes 19 at their ends.

These square holes 19 help avoid interference with the lowered chuck 16 as described later.

A U-shaped guide rib 20 is erected on the inner periphery of the busbar insertion groove 18 and an auxiliary guide rib 21 is erected in the middle of the outer periphery.

On the mounting stand C, the insulating case 10 is positioned and mounted in place of the jig plate 11.

The first embodiment of the busbar fabrication method is described in detail by referring to FIGS. 1(A) to 1(D) and FIG. 2.

Figure 1A:
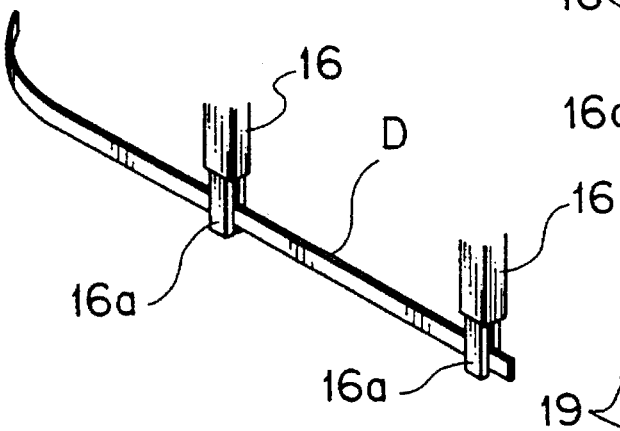
FIGS. 1(A) through 1(D) are perspective views showing the steps of the busbar fabrication method as one embodiment of this invention.

The end of the rolled thin strip of conductor D rotatably supported at the reel A is clamped by a pair of chucks 16 and is advanced a certain distance, equal to the length of busbar to be formed, toward the mounting stand C before being stopped (see FIG. 1(A)).

Then, the cutter 14 advances toward the end surface of the die 13 to cut the thin strip of conductor D, producing a conductor piece D' of a specific length.

The pair of chucks 16 holding the ends of the conductor piece D' are moved directly above the busbar insertion groove 18 (FIG. 1(B)) and then lowered to a height close to the guide rib 20, inserting the conductor piece D' between the guide rib 20 and the auxiliary guide rib 21.

Figure 1C:
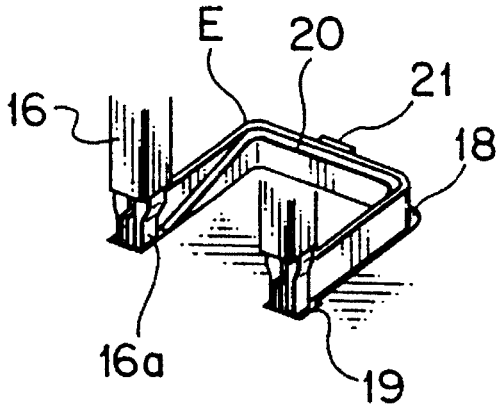

The pair of chucks 16 are moved in an arc about the corners of the guide rib 20 until they are positioned immediately above the square holes 19 (FIG. 1(C)). (At this time, the chucks 16 themselves are rotated through the angle corresponding to the arc movement to direct the clamping surface of the clamp mechanism 16*a* toward the corner of the guide rib 20.)

The auxiliary rib 21 prevents the conductor piece d' from projecting out of the busbar insertion groove 18.

Figure 1D:
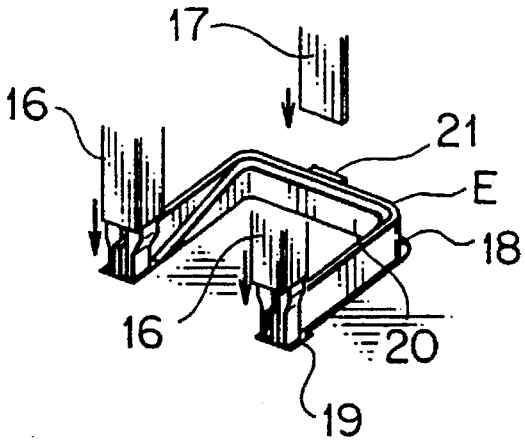

With the conductor piece D' formed into a bent busbar E of specified shape, the pair of chucks 16 are further lowered and at the same time the push pin 17 is pressed against the intermediate portion of the busbar E, causing the busbar E to be inserted into the busbar insertion groove 18 (FIG. 1(D)).

The busbar fabrication method mentioned above has the advantage of being able to automatically fabricate various kinds of busbars efficiently when the manufacturing apparatus is automated.

Because there is no need to install a die as required by the conventional equipment, the busbar production cost is further reduced.

Figure 3:
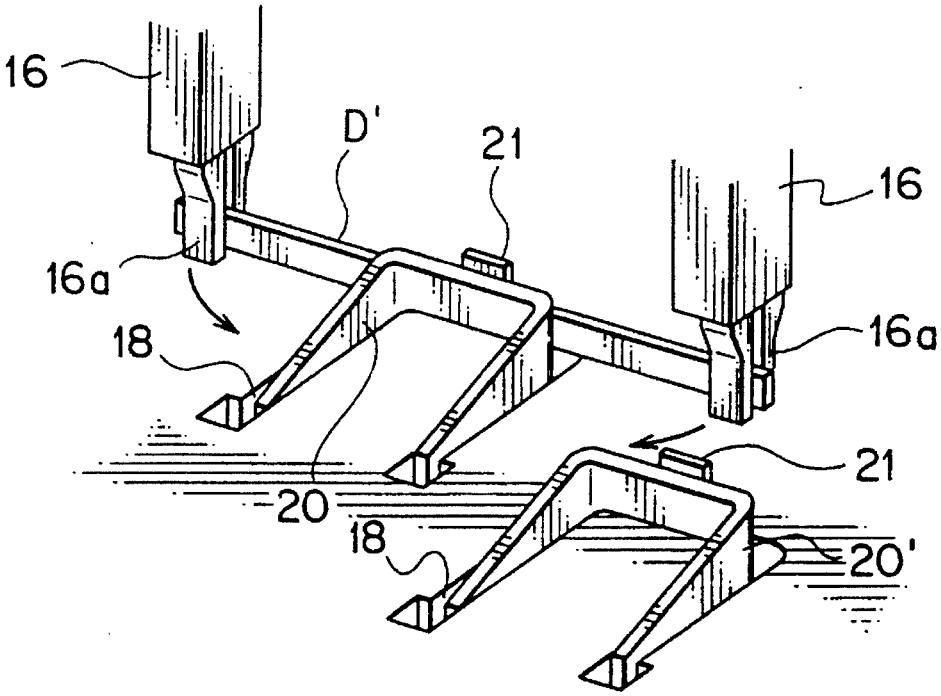
FIG. 3 is a perspective view showing how the guide rib and the chuck interfere with each other when the guide ribs come close to each other.

In the first embodiment of the busbar fabrication method mentioned above, the pair of chucks 16 which hold the ends of the conductor piece D' may interfere with another guide rib 20' located nearby, as shown in FIG. 3, when they are moved in arc. This can be solved by the second embodiment of the busbar fabrication method described below.

Second embodiment

Figure 9:
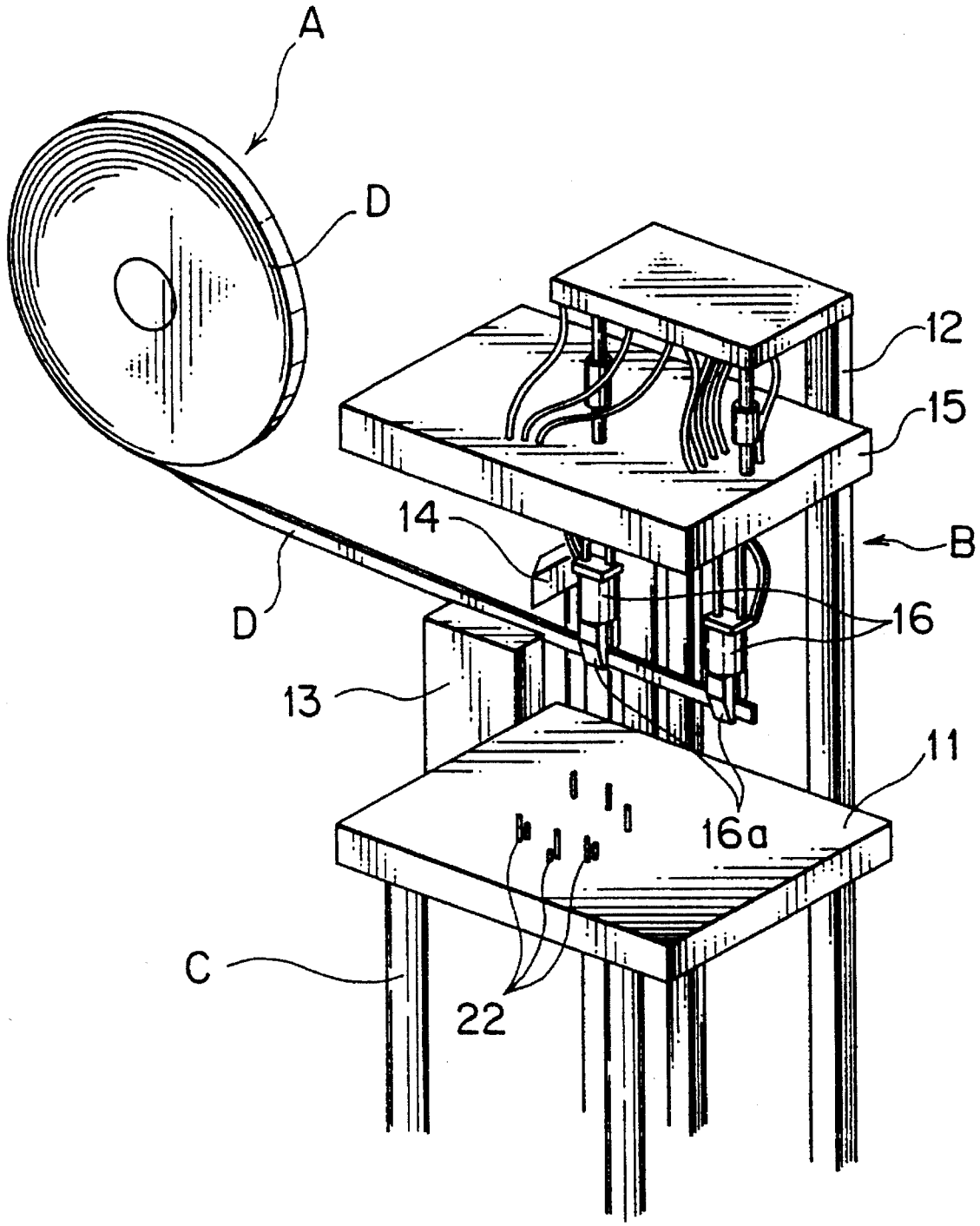
FIG. 9 is a perspective view of a fabrication apparatus that carries out the busbar fabrication method of this invention.
Figure 10:
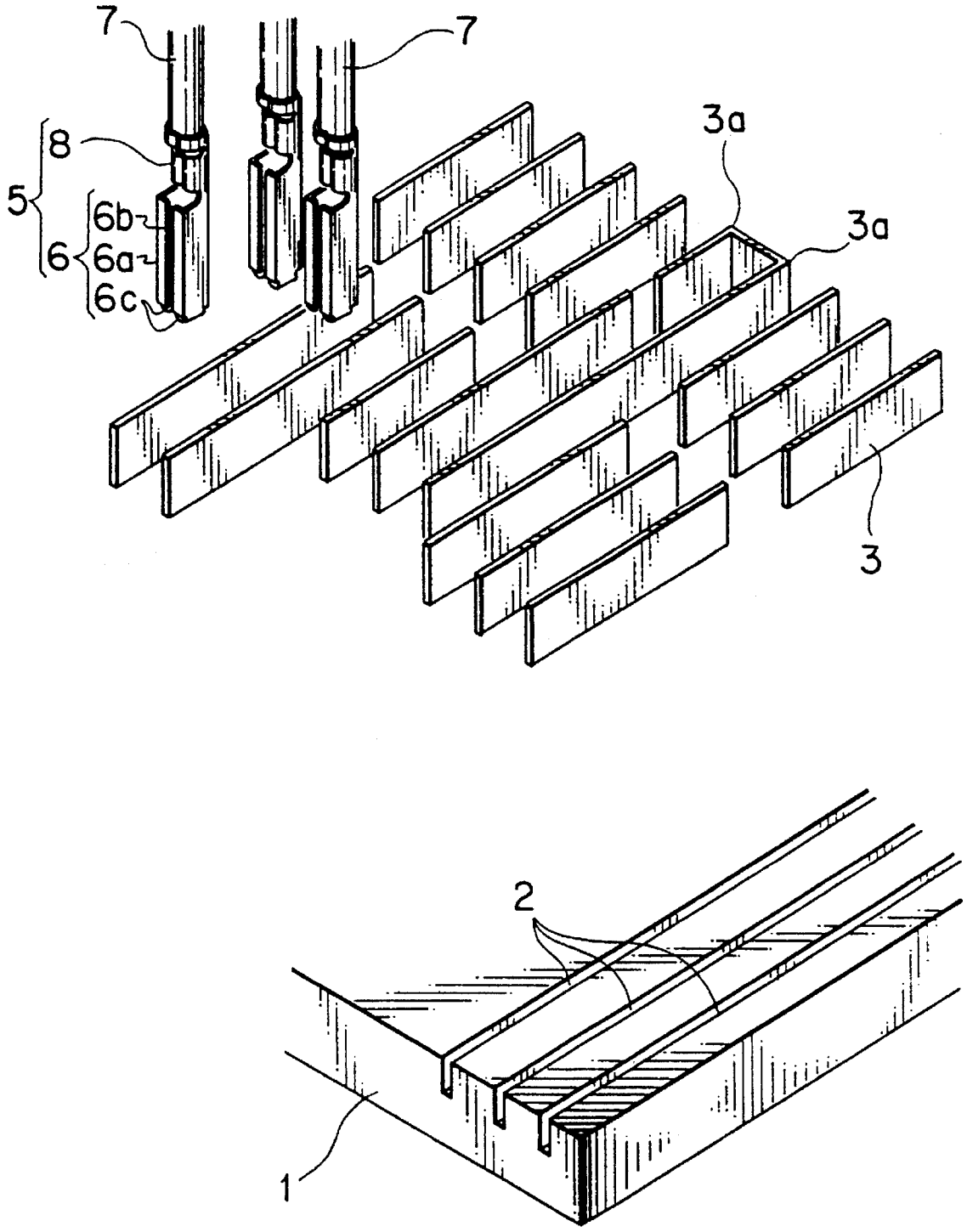
FIG. 10 is a perspective view showing conventional vertical busbars and their associated parts.

The second embodiment of the busbar fabrication method performs only the busbar forming, and as to the fabrication apparatus the second embodiment differs from the first embodiment in that the jig plate 11 is positioned and mounted on the mounting stand C (see FIG. 9).

In the second embodiment, the conductor D is preferably made of materials that are capable of plastic deformation with no large spring back after being bent.

Figure 4A:
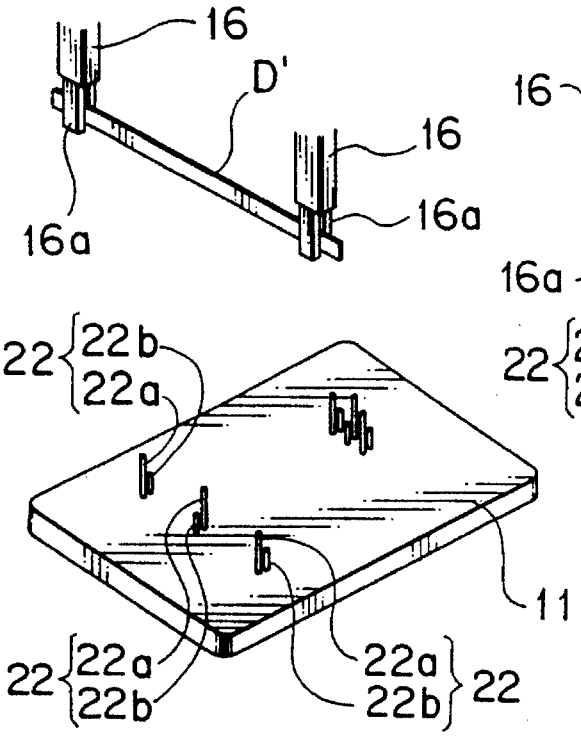
FIGS. 4(A) through 4D are perspective views showing the steps of the busbar fabrication method as the second embodiment of this invention.

As shown in FIG. 4(A), on the surface of the jig plate 11 are erected a plurality of holders 22, each consisting of a pair of a long pins 22*a* and a short pin 22*b* so spaced from each other as to allow insertion of the strip of conductor D therebetween.

As in the first embodiment, the conductor piece D' cut to a specified length is held at both ends by the clamping mechanisms 16*a* of the chucks 16 and then positioned directly above three sets of holders 22 arranged in a straight line.

Of the three holders 22, those on both sides are located at the bending position of the conductor piece D' and the center holder 22, which has its long pin 22*a* and short pin 22*b* reversed in position, is designed to prevent the central portion of the conductor piece D' being bent from projecting outwardly.

Figure 4B:
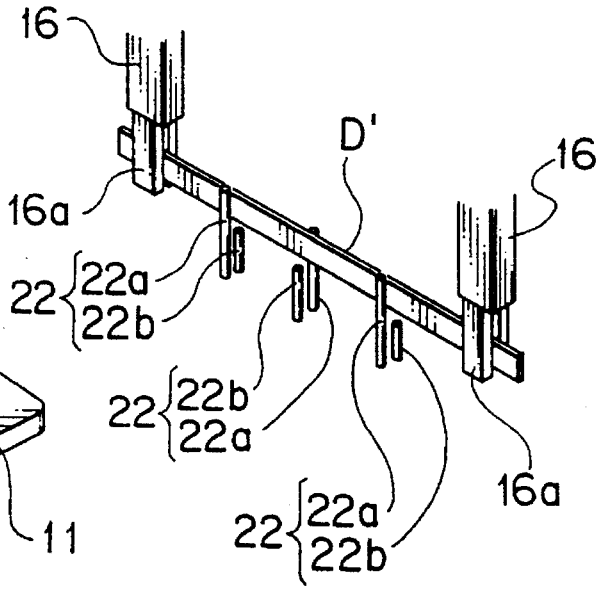
Figure 4C:
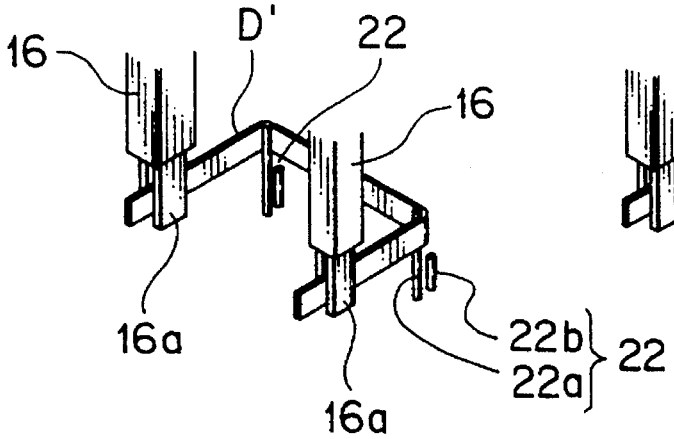

Then, the pair of chucks 16 are lowered until the conductor piece D' comes close to the long pin 22*a* of each holder 22 (see FIG. 4(B)), and as in the first embodiment, the chucks 16 are moved in an arc to bend the conductor piece D' in the U shape (see FIG. 4(C)).

Figure 4D:
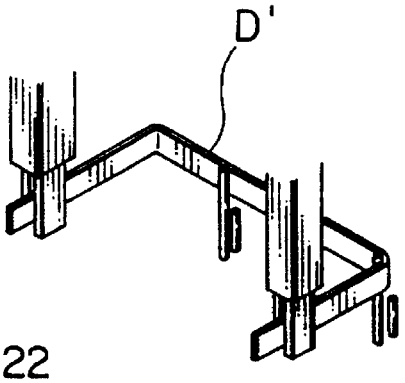

When the central portion of the U-shaped conductor piece D' is long, the conductor cannot be bent in one step. In FIG. 4(D), the left side portion of the conductor piece D' is first bent. The conductor piece D' is then moved toward the left and the right side portion is bent, thus producing a busbar with a long central portion.

Although such a U-shaped busbar can be bent and formed by only the long pin 22*a*, the bending of the conductor piece D' can also be done by inserting it between the long pin 22*a* and the short pin 22*b*.

Figure 5A:
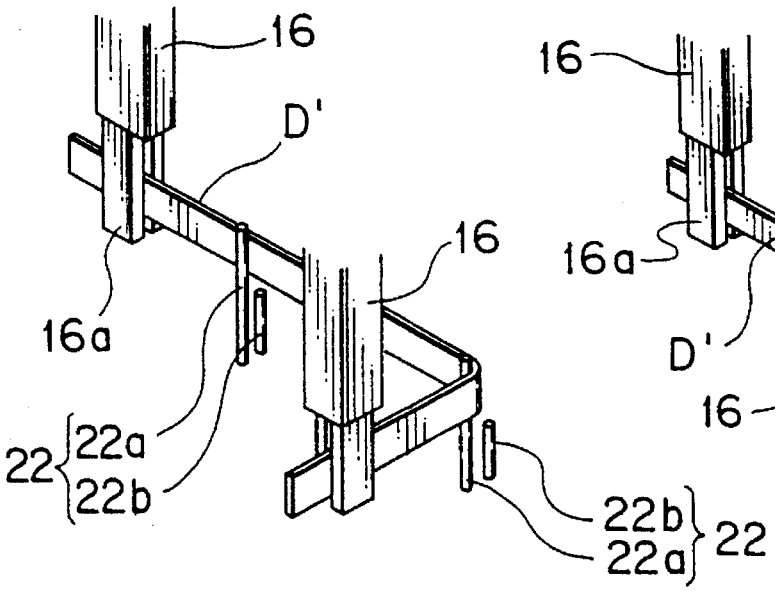
FIGS. 5(A) through 5(C) are perspective views showing the steps of the busbar fabrication method of the second embodiment when forming a busbar of a special shape.
Figure 5B:
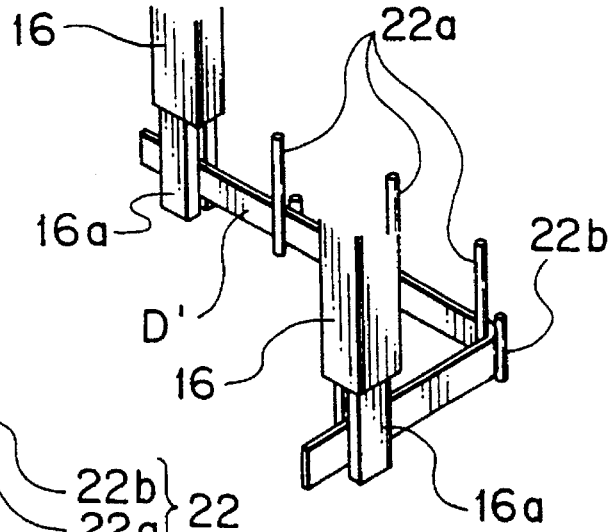
Figure 5C:
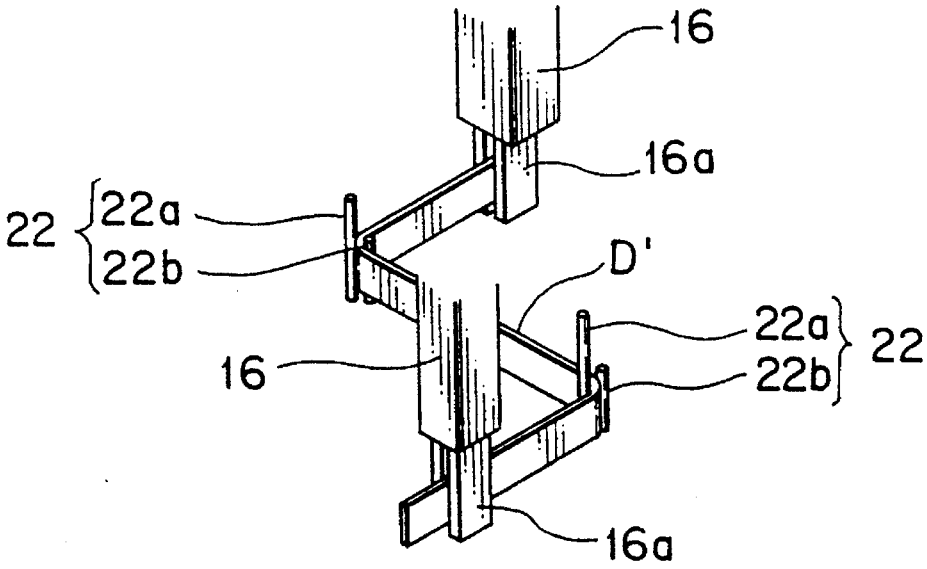

FIG. 5(A) to 5(C) are perspective views showing the process of forming a zigzag-shaped busbar which has its one end bent in one direction and the other in the other direction.

To form a zigzag-shaped busbar, the right-hand side chuck 16 in FIG. 5(A) is moved in an arc to bend the busbar into an L shape and then lowered to insert the conductor piece D' between the long pin 22*a* and the short pin 22*b* (FIG. 5(B)). The left-hand side chuck 16 is then moved in arc toward the outside to form a zigzag-shaped busbar (FIG. 5(C)).

Figure 6:
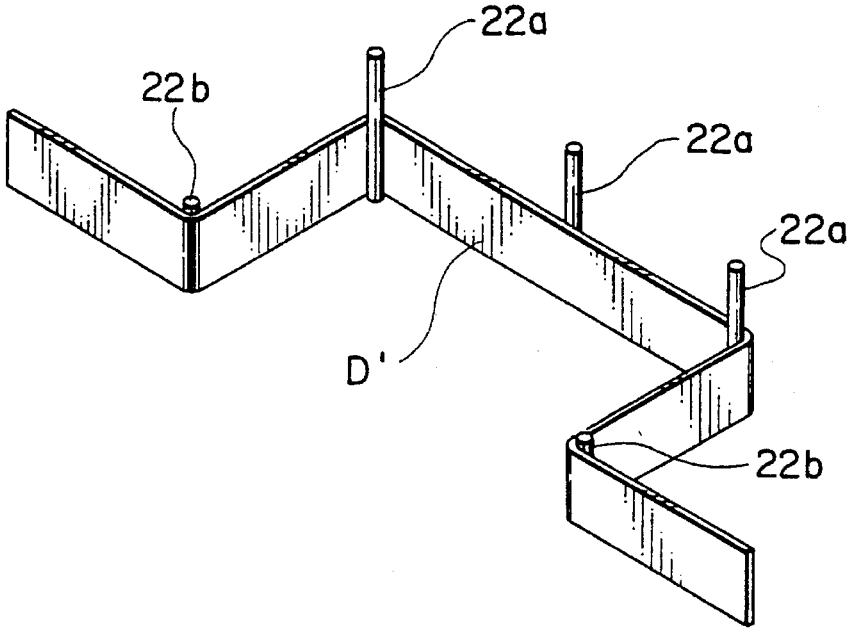
FIG. 6 is a perspective view showing how another busbar of a special shape is formed.

In a jig plate 11 in which three long pins 22*a* are arranged almost in a straight line and short pins 22*b* are spaced from the long pins on both sides in a direction perpendicular to the straight line as shown in FIG. 6, the chucks 16 holding the ends of the conductor piece D' are lowered and stopped at a height where they do not contact the short pins 22*b*. Then, the chucks 16 are moved in an arc to bend the conductor piece D' in a shape of letter U and then lowered to a height where they are close to the short pins 22*b*. Then, the chucks 16 are moved in arc outwardly, thereby forming a complex shaped busbar that is bent outwardly from the ends of the U-shaped portion.

In this way, busbars can be formed in various shapes by properly arranging the long pins 22*a* and short pins 22*b* as required.

The method of automatically inserting the bent busbar E thus formed into an insulating case 23 by means of a busbar fabrication apparatus will be described by referring to FIGS. 7(A) to 7(D).

Figure 7A:
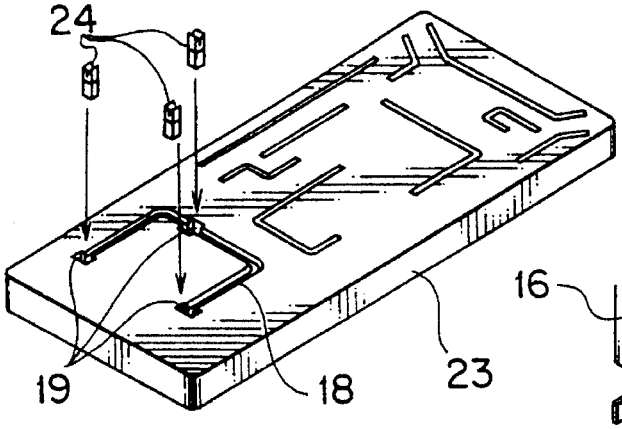
FIGS. 7(A) through 7(D) are perspective views showing the steps of the busbar insertion method.

In the surface of the insulating case 23 shown in FIG. 7(A) is formed a busbar insertion groove 18 having three square holes 19 into which female terminals are inserted.

After the female terminals 24 are inserted into the square holes 19, the insulating case 23 is mounted and positioned on the mounting stand C.

Figure 7B:
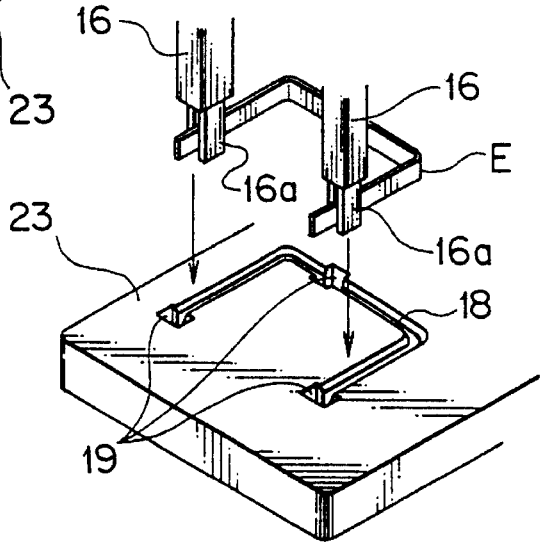
Figure 7C:
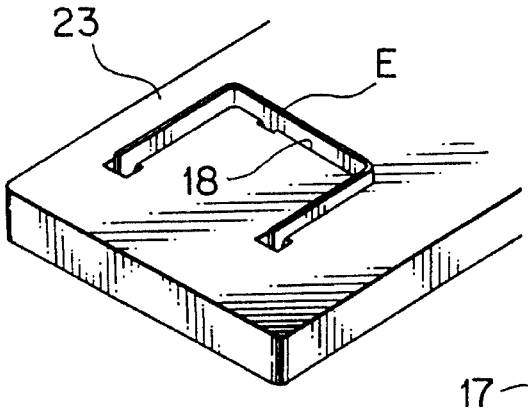
Figure 7D:
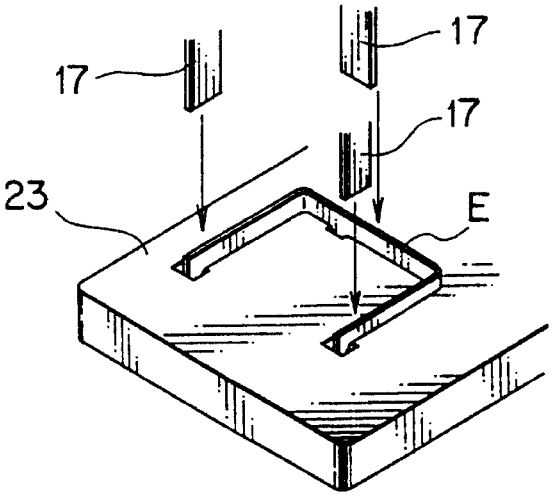

Then, the busbar E is held at its ends by the chucks 16 and moved directly above the busbar insertion groove 18 (see FIG. 7(B)). The chucks 16 are then lowered to insert the lower half of the busbar E into the busbar insertion groove 18 (FIG. 7(C)), after which the push pin 17 is lowered to push down the busbar E (FIG. 7(D)) to fully insert it into the busbar insertion groove 18.

Because of the construction described above, the present invention has the following advantages.

(1) From feeding the strip of conductor rolled in coil, to cutting the conductor into a conductor piece of a specified length, to bending the conductor piece into a busbar of various shapes (or further to inserting it into the busbar insertion groove), the fabrication process can be performed continuously without using a die.

This fabrication method is easily automated, and the production cost of busbars can be reduced significantly since there is no need to manufacture a die.

(2) Using the fabrication apparatus dedicated to this method, it is possible to insert the formed busbar.

(3) Because a hoop material can be used as the busbar material, it is possible to reduce the busbar material cost.

What is claimed is:

1. A method of making busbars comprising the steps of:

cutting a belt-shaped thin electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above an insulating case having at least one bent guide groove therein and a guide rib rising from one side wall of said guide groove along said guide groove;

lowering said pair of chucks to bring said piece of conductor into contact with said guide rib;

causing at least one of said pair of chucks to move in a horizontal arcuate path about said guide rib to cause said piece of conductor to abut around said guide rib, thereby forming said piece of conductor into a busbar configured to said guide groove; and lowering said pair of chucks to insert said busbar into said guide groove.

2. A method of making busbars comprising the steps of:

cutting a belt-shaped thin, plastically deformable electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above a jig plate having at least one pin rising from a surface thereof;

lowering the pair of chucks to position said piece of conductor into contact with said pin; and causing at least one of said pair of chucks to move in a horizontal arcuate path about said pin to cause said piece of conductor to bend.

3. The method of claim 2, including a step of unwinding the belt shaped thin, plastically deformable electrical conductor from a reel prior to said step of cutting.

4. The method of claim 2, including a step of lowering said bent piece of conductor into a bent guide groove of an insulating case.

5. The method of claim 4, wherein said step of lowering includes lowering said bent piece of conductor by lowering the chucks.

6. The method of claim 5, wherein said step of lowering also includes contacting an upper surface of the bent piece of the conductor with a push pin.

7. A method of making busbars comprising the steps of:

cutting a belt-shaped thin, plastically deformable electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above a jig plate having a plurality of holders, each of which including a long pin and a short pin positioned relative to the long pin so that said piece of conductor is insertable therebetween;

lowering said pair of chucks to position said piece of conductor into contact with a long pin of a first holder of said plurality of holders;

causing a first chuck of said pair of chucks to move in a horizontal arcuate path about said long pin to cause said piece of conductor to bend;

lowering said pair of chucks to insert said piece of conductor between the long pin and the short pin of said first holder while also inserting said piece of conductor between a long pin and a short pin of a second holder; and causing a second chuck of said pair of chucks to move in a horizontal arcuate path about the short pin of said second holder to cause said piece of conductor to bend.

8. A method of making busbars comprising the steps of:

cutting a belt-shaped thin, plastically deformable electrical conductor into a piece of conductor of a predetermined length, said piece of conductor having a first end portion and a second end portion;

holding said first and second end portions of said piece of conductor with a pair of chucks, each of said chucks having a grasping mechanism to grasp said end portion and being adapted to move vertically, horizontally, and in a horizontal arcuate path;

positioning the pair of chucks above a jig plate having a plurality of holders, each of which including a long pin and a short pin positioned relative to the long pin so that said piece of conductor is insertable therebetween;

lowering said pair of chucks to insert said piece of conductor between the long pin and the short pin of a first of said holders while also inserting said piece of conductor between a long pin and a short pin of a second of said holders; and causing a second chuck of said pair of chucks to move in a horizontal arcuate path about the short pin of said second holder to cause said piece of conductor to bend.

* * * * *